US010455677B2

(12) United States Patent
Kang et al.

(10) Patent No.: US 10,455,677 B2
(45) Date of Patent: Oct. 22, 2019

(54) X-RAY GENERATOR AND DRIVING METHOD THEREOF

(71) Applicant: ELECTRONICS AND TELECOMMUNICATIONS RESEARCH INSTITUTE, Daejeon (KR)

(72) Inventors: Jun Tae Kang, Daejeon (KR); Yoon-Ho Song, Daejeon (KR); Jin-Woo Jeong, Daejeon (KR)

(73) Assignee: ELECTRONICS & TELECOMMUNICATIONS RESEARCH INSTITUTE, Daejeon (KR)

( * ) Notice: Subject to any disclaimer, the term of this patent is extended or adjusted under 35 U.S.C. 154(b) by 325 days.

(21) Appl. No.: 15/459,661

(22) Filed: Mar. 15, 2017

(65) Prior Publication Data

US 2017/0347438 A1 Nov. 30, 2017

(30) Foreign Application Priority Data

May 25, 2016 (KR) ..... 10-2016-0064299
May 30, 2016 (KR) ..... 10-2016-0066717

(51) Int. Cl.
*H05G 1/34* (2006.01)
*H01J 35/06* (2006.01)
(Continued)

(52) U.S. Cl.
CPC ..... *H05G 1/34* (2013.01); *H01J 35/065* (2013.01); *H05G 1/10* (2013.01); *H05G 1/32* (2013.01)

(58) Field of Classification Search
CPC .... H01J 35/065; H01J 35/14; H01J 2235/087; H01J 2235/165; H01J 35/16; H01J 35/30; H01J 35/32; H01J 2201/30469; H01J 2235/06; H01J 2235/062; H01J 2235/064; H01J 35/08; H01J 35/116; H01J 2235/081; H01J 35/06; H01J 35/18; H01J 2235/068;
(Continued)

(56) References Cited

U.S. PATENT DOCUMENTS 6,259,765 B1 * 7/2001 Baptist ..... H01J 35/065 313/309
6,333,968 B1 * 12/2001 Whitlock ..... B82Y 10/00 378/122
(Continued)

FOREIGN PATENT DOCUMENTS

KR 10-2011-0019158 A 2/2011
KR 10-2012-0064783 A 6/2012
(Continued)

*Primary Examiner* — Irakli Kiknadze

(57) ABSTRACT

Provided is an X-ray generator including a thermal electron emission type X-ray generator configured to generate a negative high voltage and a filament current, a field electron emission type X-ray generator including an anode electrode to be grounded, and configured to use the negative high voltage to bias the cathode electrode, and a field emission current control unit configured to convert the filament current to generate an output voltage to be provided to a gate electrode of the field electron emission type X-ray generator and convert the filament current to fix, to a specific level, a level of an emission current flowing through the cathode electrode.

18 Claims, 8 Drawing Sheets

(51) Int. Cl.
*H05G 1/32* (2006.01)
*H05G 1/10* (2006.01)

(58) Field of Classification Search
CPC ..... H01J 2235/086; H01J 2235/163; H01J 2235/18; H01J 35/186; H05G 1/10; H05G 1/32; H05G 1/34; H05G 1/70; H05G 1/52; B82Y 10/00; A61B 6/032; A61B 6/4021; A61B 6/405; A61B 6/4028; A61B 6/4488; A61B 6/482; G01N 23/04; G01N 23/046; G01N 23/22; G01N 9/24
USPC ..... 378/109, 136, 138, 121, 119; 977/939, 977/950; 313/495–497; 315/167, 169
See application file for complete search history.

(56) References Cited

U.S. PATENT DOCUMENTS

| | | | | |
|---|---|---|---|---|
| 8,503,614 | B2 * | 8/2013 | Legagneux ..... | H01J 35/065 378/122 |
| 8,942,352 | B2 | 1/2015 | Jeong et al. | |
| 2012/0148027 | A1 | 6/2012 | Jeong et al. | |

FOREIGN PATENT DOCUMENTS

| | | | |
|---|---|---|---|
| KR | 10-2012-0111895 | A | 10/2012 |
| WO | WO 2011/021792 | A2 | 2/2011 |

* cited by examiner

X-RAY GENERATOR AND DRIVING METHOD THEREOF

CROSS-REFERENCE TO RELATED APPLICATIONS

This U.S. non-provisional patent application claims priority under 35 U.S.C. § 119 of Korean Patent Application Nos. 10-2016-0064299, filed on May 25, 2016, and 10-2016-0066717, filed on May 30, 2016, the entire contents of which are hereby incorporated by reference.

BACKGROUND

The present disclosure herein relates to an X-ray generator, and more particularly, to a field electron emission type X-ray generator and a driving method for stably driving the same.

In order to generate an X-ray, a manner is used in which an electron emitted in a vacuum tube is accelerated and the accelerated electron is struck to an anode electrode. As the manner for emitting the electron, a thermal electron emission type and a field electron emission type are largely used, As a typical X-ray tube, the thermal electron emission type is used the most, which heats a filament in a vacuum glass tube. Recently, researches are being actively performed on an electric field emission type X-ray tube for which a digital control is easy.

A commercialized thermal electron emission type X-ray generator uses a current source for providing a current flowing through a tungsten filament that is an electron emission source. Unlike this, a field electron mission type X-ray generator emits an electron by applying a high voltage to a metal tip or a carbon nano tube. The field electron emission type X-ray generator (or tube) is driven by grounding a cathode electrode and applying a positive voltage to gate and anode electrodes.

However, for the field electron emission type X-ray generator applied to non-destruction inspection equipment, it is necessary that a target is externally exposed or heat generated at the anode electrode is effectively removed. In this case, it is necessary to connect the anode electrode to a ground and apply a negative voltage to the gate and cathode electrodes. In order to drive the X-ray generator in such a way, it is necessary to generate a negative high voltage and a voltage higher than the negative high voltage by a prescribed level. Accordingly, there is a limitation that it is very difficult to realize a method for driving the field electron emission type X-ray generator of which the anode electrode is grounded in consideration of insulation and stability.

SUMMARY

The present disclosure provides an X-ray generator for stably driving a field electron emission type X-ray generator and a driving method thereof.

An embodiment of the inventive concept provides an X-ray generator including: a thermal electron emission type X-ray generator configured to generate a negative high voltage and a filament current; a field electron emission type X-ray generator including an anode electrode to be grounded, and configured to use the negative high voltage to bias the cathode electrode; and a field emission current control unit configured to convert the filament current to generate an output voltage to be provided to a gate electrode of the field electron emission type X-ray generator and convert the filament current to fix, to a specific level, a level of an emission current flowing through the cathode electrode.

In an embodiment of the inventive concept, an X-ray generator includes: a field electron emission type X-ray generator of which anode electrode is grounded; and a field emission current control unit configured to receive a source current to generate an output voltage to be provided to a gate electrode of the field electron emission type X-ray generator on a basis of a negative high voltage, and use the source current to control an emission current flowing through a cathode electrode of the field electron emission type X-ray generator.

In an embodiment of the inventive concept, a method for driving a field electron emission type X-ray generator of which an anode electrode is grounded, includes: receiving a negative high voltage and a filament current from a thermal electron emission type X-ray generator; converting the filament current to generate an output voltage to be provided to a gate electrode of the field electron emission type X-ray generator; converting the filament current to generate a current controlled voltage for controlling an emission current flowing through a cathode electrode of the field electron emission type X-ray generator; and providing the output voltage to the gate electrode and applying the current controlled voltage as a gate-source voltage of a transistor configured to deliver the negative high voltage to a cathode electrode of the field electron emission type X-ray generator.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
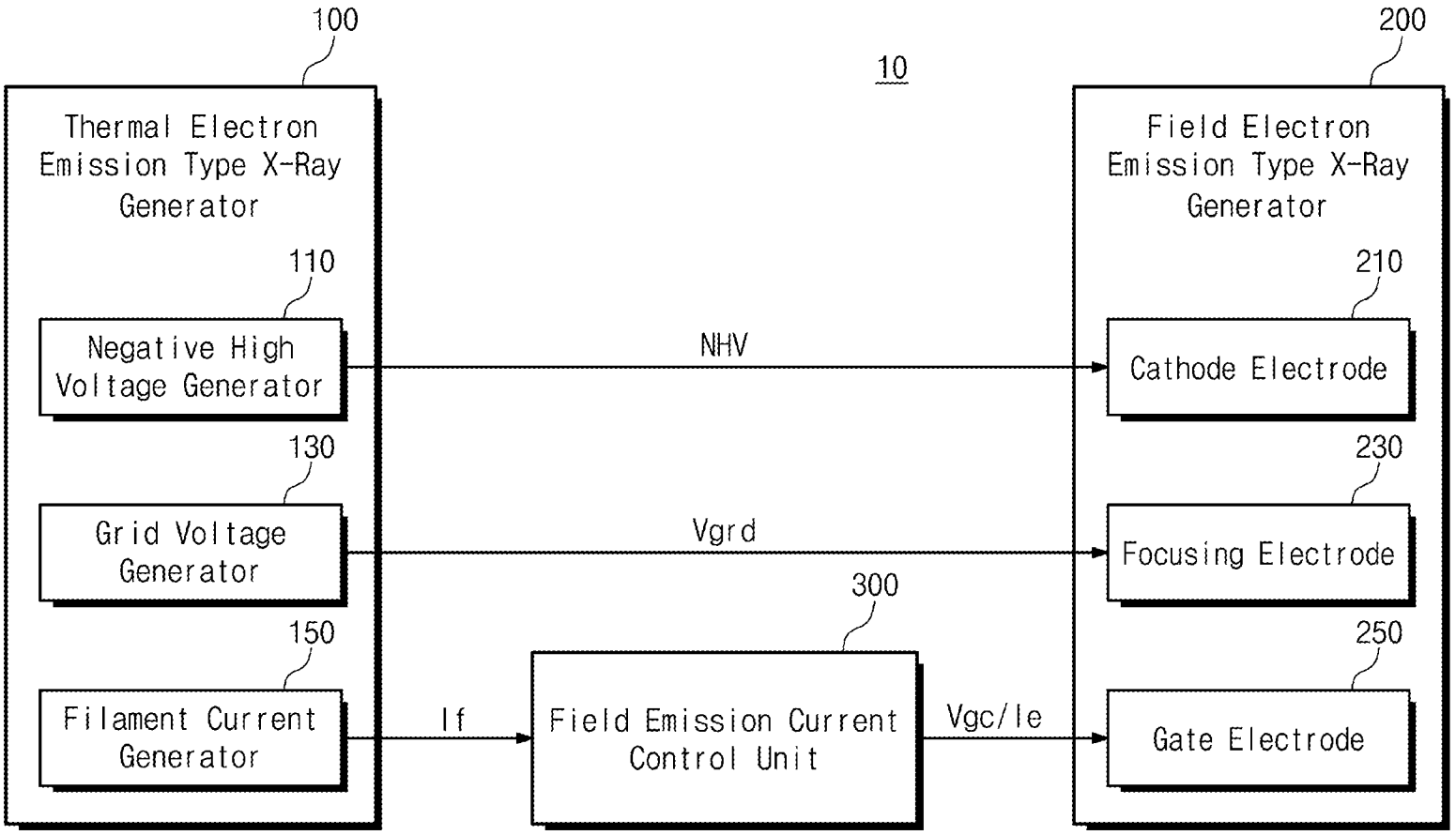
FIG. 1 is a block diagram showing an X-ray generator according to an embodiment of the inventive concept.

Hereinafter, an exemplary embodiment of the present invention will be described in detail with reference to the accompanying drawings such that a person skilled in the art may easily carry out the embodiments of the inventive concept. Hereinafter, a means and method for simply and stably driving a field electron emission type X-ray generator with a thermal electron emission type X-ray generator will be described in detail with accompanying drawings.

The terms and words used in the following description and claims are to describe embodiments but are not limited the inventive concept. As used herein, the singular forms "a," "an" and "the" are intended to include the plural forms as well, unless the context clearly indicates otherwise. It will be further understood that the terms "comprises" and/or "comprising" used herein specify the presence of stated components, operations and/or elements but do not preclude the presence or addition of one or more other components, operations and/or elements. In addition, as just exemplary embodiments, reference numerals shown according to an order of description are not limited to the order. In particular, a term "negative voltage" means a lower level than a ground level 0V.

FIG. 1 is a block diagram for showing an X-ray generator according to an embodiment of the inventive concept. Referring to FIG. 1, an X-ray generator 10 includes a thermal electron emission X-ray generator 100, a field electron emission type X-ray generator 200 and a field emission current control unit 300.

The thermal electron emission type X-ray generator 100 includes a structure for emitting a thermal electron by feeding a current to a filament that is a cathode. The thermal electron emission X-ray generator 100 may include a negative high voltage generator 100, a grid voltage generator 130, and a filament current generator 150. The negative high voltage generator 110 may include a negative high voltage generator 110 for providing a negative high voltage (NHY) to the filament or the cathode (or a cathode electrode). In addition, the grid voltage generator 130 generates a grid voltage Vgrd to be provided to a grid electrode for controlling an emitted thermal electron. In addition, the filament current generator 150 generates a filament current If for emitting the thermal electron to provide the filament current If to the filament. Other power sources of various levels may be used for the thermal electrode emission type X-ray generator 100, but such configurations are out of the category of the inventive concept and therefore descriptions thereabout will be omitted.

The field electron emission type X-ray generator 200 has an anode electrode (not illustrated) grounded to a ground voltage (or 0 V). The field electron emission type X-ray generator 200 may receive the negative high voltage NHY and grid voltage Vgrd from the thermal electron emission type X-ray generator 100. In addition, the emission current le generated by the field electron emission type X-ray generator 200 may be stably and easily controlled by the field emission current control unit 300.

The anode electrode of the field electron emission type X-ray generator 200 may be grounded. In addition, the cathode electrode 210 of the field electron emission type X-ray generator 200 is biased to the negative high voltage. Furthermore, a gate-cathode voltage higher than that of the cathode electrode 210 by a specific level is supplied to a gate electrode 250 of the field electron emission type X-ray generator 200. Then, electrons are emitted by an electric field generated between the gate electrode 250 and the cathode electrode 210. At this point, the grid voltage Vgrd provided from the thermal electron emission type X-ray generator 100 may be applied as a focusing voltage for focusing electronic beams.

The field emission current control unit 300 receives, as a current source, the filament current If provided from the filament current generator 150 of the thermal electron emission type X-ray generator 100. The field emission current control unit 300 may control the emission current le flowing through the cathode electrode 210 using the filament current If and generate the gate voltage to be applied to the gate electrode 250. First, the field emission current control unit 300 generates a DC voltage using the filament current If. In addition, the field emission current control unit 300 may step up the generated DC voltage to provide the stepped-up DC voltage to the gate electrode 250. Here, the DC voltage and the stepped-up DC voltage are voltages of specific levels on the basis of the negative high voltage NHY. Furthermore, the field current control unit 300 may generate a DC voltage using the filament current If and control a level of the emission current le using the generated DC voltage. Such a function of the field emission current control unit 300 will be described in detail in relation to FIG. 4.

According to the X-ray generator 10 of the inventive concept, a driving voltage and current of the field electron emission type X-ray generator 200 may be controlled or provided using the negative voltage NHY and filament current If of the thermal electron emission type X-ray generator 100. The anode electrode of the field electron emission type X-ray generator 200 is grounded and the negative high voltage NHY, which is provided from the thermal electron emission type X-ray generator 100, may be provided to the gate electrode 250 and the cathode electrode 210. Furthermore, the emission current le, generated by electrons emitted from an emitter is controllable through the field emission current control unit 300. Consequently, according to an embodiment of the inventive concept, simple and stable driving power may be provided to the field electron emission type X-ray generator 200 of which the anode electrode is required to be grounded.

Figure 2:
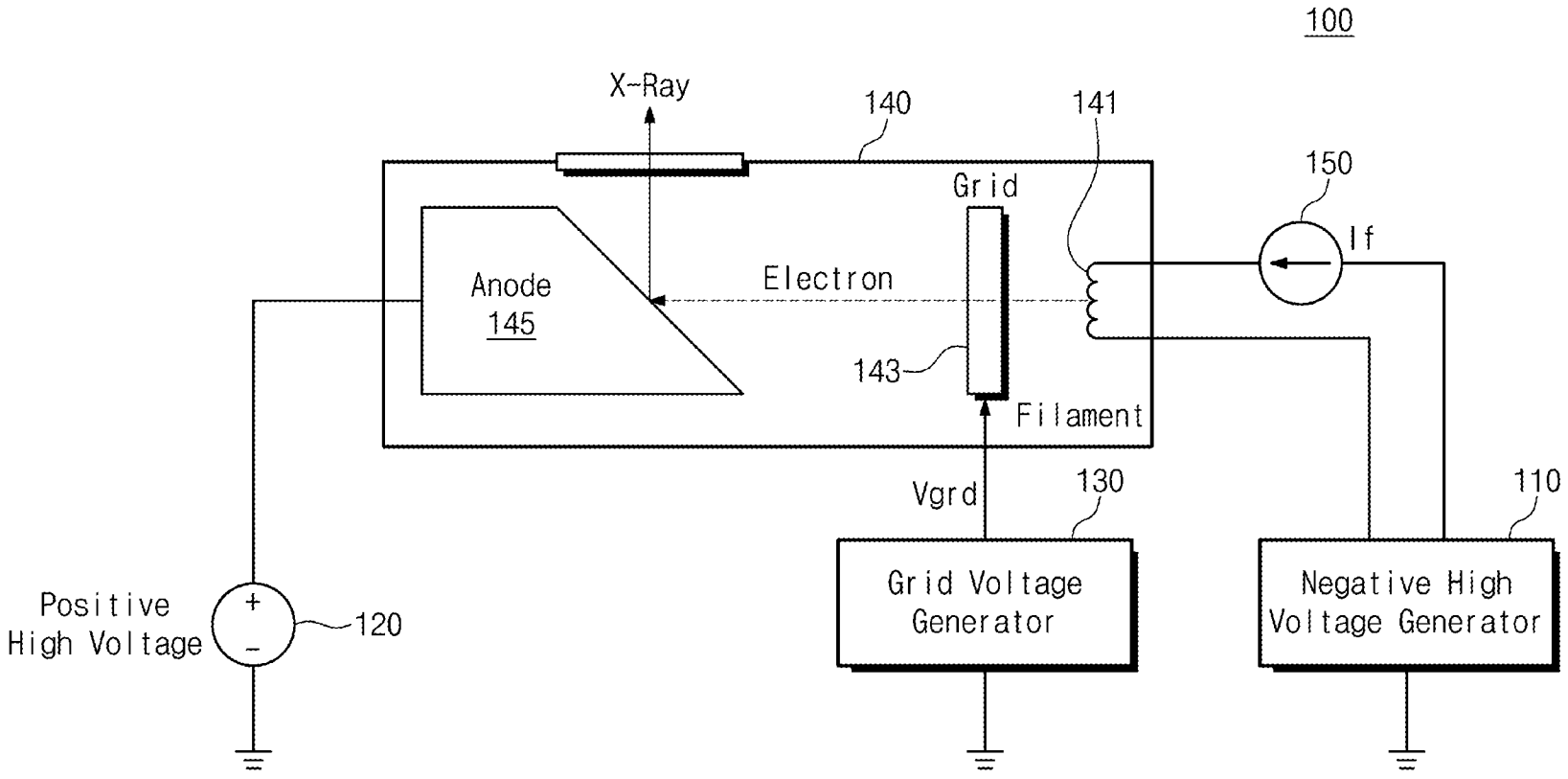
FIG. 2 is a block diagram showing a configuration of the thermal electron emission type X-ray generator of FIG. 1.

FIG. 2 is a block diagram for showing a configuration of the thermal electron emission type X-ray generator of FIG. 1. Referring to FIG. 2, the thermal electron emission X-ray generator 100 may include a negative high voltage generator 110, a positive high voltage generator 120, a grid voltage generator 130, a cathode ray tube 140, and a filament current generator 150.

The negative high voltage generator 110 generates the negative high voltage NHY to be provided to a filament 141 in the cathode ray tube 140. The negative high voltage generator 110 generates the negative high voltage NHY of several kV to hundreds kV to provide a cathode potential of the filament 141.

The positive high voltage generator 120 provides a positive high voltage PHY to an anode 145. An emission electron may be accelerated in the cathode ray tube 140, which is in a vacuum state, by a potential difference between the cathode formed by the filament 141 and the anode formed by the anode 145.

The grid voltage generator 130 generates a grid voltage Vgrd to be provided to a grid 143 for controlling the emitted electron. The grid voltage generator 130 generates the grid voltage Vgrd of a relatively low positive voltage level. The thermal electron emission type X-ray generator 100 determines an amount of emitted electrons reaching the anode 145 according to the level of the grid voltage Vgrd.

The cathode ray tube 140 includes a glass tube for providing high vacuum, and the filament 141, the grid 143, and the anode 145 provided in the glass tube. The filament 141 forms the cathode (or cathode electrode) and is heated to a high temperature by the filament current If. The filament 141 emits a thermal electron in a high temperature state and the emitted thermal electron is accelerated by a potential difference between the cathode and anode of the cathode ray tube 140. The filament 141 may be typically configured from a material such as tungsten of which a melting point is high and an evaporation point is high. The grid 143 controls the speed or amount of the thermal electron emitted from the filament 141 and moved toward the anode electrode 154. The grid 143 may be typically arranged around the filament 141 and formed in a spiral or lattice type with a material such as tungsten or molybdenum. The anode 145 includes an electrode or a target which a thermal electron beam accelerated in a high speed collides with and emits an X-ray. The anode 120 receives the positive high voltage.

The filament current generator 150 generates an emission current and provides the emission current to the filament 141 of the cathode ray tube 140. When the filament current If flows through the filament 141, a thermal energy is generated and a thermal electron may be emitted by the generated thermal energy.

Hereinabove, the structure of the thermal electron emission type X-ray generator 100 including the negative high voltage generator 110, the grid voltage generator 130, and the filament current generator 150 has been briefly described, The thermal electron emission X-ray generator 100 is provided with the negative high voltage generator 110, the grid voltage generator 130, and the filament current generator 150 in order to emit the thermal electron to generate the X-ray. In the inventive concept, the field electron emission type X-ray generator 200 of which the anode electrode is grounded may be easily driven using power supply sources of this thermal electron emission type X-ray generator 100.

Figure 3:
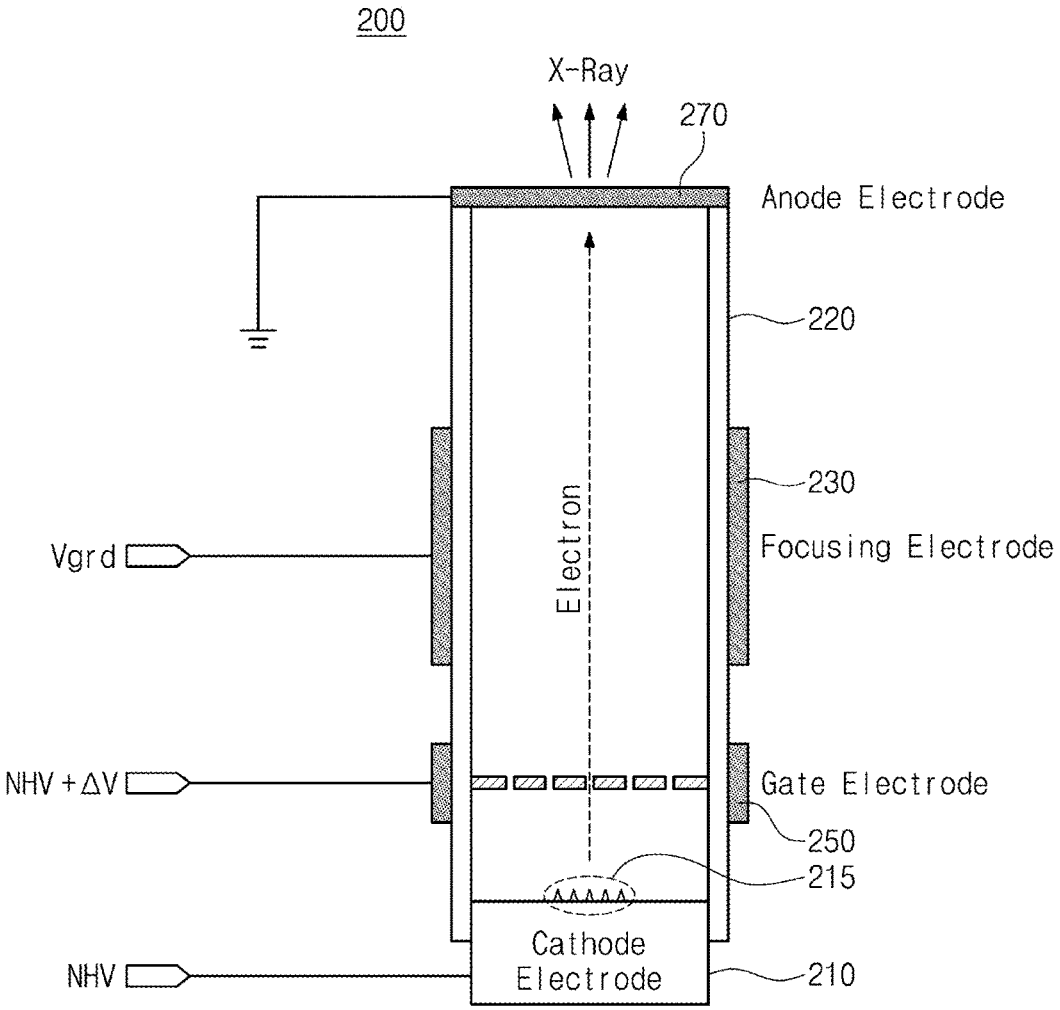
FIG. 3 is a cross-sectional view showing the field electron emission X-ray generator 200.

FIG. 3 is a cross-sectional diagram for showing the field electron emission X-ray generator 200. Referring to FIG. 3, the field electron emission X-ray generator 200 may include a cathode electrode 210, a vacuum container 220, a focusing electrode 230, a gate electrode 250, and an anode electrode 270. Here, the anode electrode 270 is exemplified to have a transmissive structure but may have a reflective type structure in which an X-ray is reflected by a target and emitted. It may be understood that the focusing electrode 230 and the gate electrode 250 are formed in various types and are also formed in a mesh type in the vacuum container 220.

The cathode electrode 210 is provided at one end part of the vacuum container 220. Inside the cathode electrode 210, an electron emitting emitter 215 is formed to emit an electron by a high electric field. The electron emitting emitter 215 may be formed by depositing, on a plane of the cathode electrode 210, a metal tip, a carbon nano tube, or magnetic or non-magnetic metal powder chemically or physically adhesive to an oxidizer of the carbon nano tube by heating. It will be well understood that the method for forming the electron emission emitter 215 is not limited thereto, and the electron emission emitter 215 may be formed with various materials or in various deposition manners.

In particular, since the electron is required to be emitted from the electron emission emitter 215, it is necessary to form a high electric field from the anode electrode 270 toward the cathode electrode 210. The anode electrode 270 of the field electron emission X-ray generator 200 of the inventive concept is subject to a grounded structure. Accordingly, it is necessary to provide a negative high voltage NHY to the cathode electrode 210 in order to provide a high electric field from the gate electrode 250 and the anode electrode 270 toward the cathode electrode 210. The negative high voltage NHY may be provided in, for example, a DC type or a pulse type.

The electrons emitted from the electron emission emitter 215 may be focused by a control voltage provided to the focusing electrode 230. The focusing of the emitted electrode is performed by an electric field formed by a voltage provided to the focusing electrode 230. In other words, a lens effect for an electron beam may be provided by the electric field formed by the focusing electrode 230. The focusing electrode 230 may be provided in various types and formed inside or outside the vacuum container 220 in various types according to various purposes. In particular, the voltage provided to the focusing electrode 230 may be the grid voltage Vgrd used in the thermal electron emission type X-ray generator 100. In other words, the grid voltage Vgrd provided from the thermal electron emission type X-ray generator 100 may be directly applied to the focusing electrode 230 or a level of which may be changed and then applied to the focusing electrode 230.

The gate electrode 250 has a structure for providing a relative potential difference with the cathode electrode 210 to provide an electric field for emitting an electron from the electron emission emitter 215. The electric field is formed from the gate electrode 250 toward the cathode electrode 210 by a potential difference $\Delta V$ between the gate electrode 250 and the cathode electrode 210. Accordingly, the magnitude of the electric field for electron emission is a function of the potential $\Delta V$ and an interval between the gate electrode 25 and the cathode electrode 210. The gate electrode 250 may be provided, for example, in a mesh type in which a plurality of holes are formed. However, it may be well understood that the gate electrode 250 is formed in various types other than the mesh type.

The anode electrode 270 may be provided as the target and electrode from which an X-ray is emitted by an energy generated when the emitted electron is accelerated to collide. The anode electrode 270 may be connected to a cooler including a heat dissipation plate, cooling water, or the like to be grounded (0 V) so that a heat generated by a strike of an electron beam may be easily cooled.

Hereinabove, the field electron emission type X-ray generator 200 according to an embodiment of the inventive concept has beed exemplarily described. When the field electron emission type X-ray generator 200 is used as non-destruction inspection equipment, since a target part of the anode electrode 270 is exposed externally, the anode electrode 270 may be grounded. Furthermore, even when a heat generated in the anode electrode 270 is desired to be effectively removed, the anode electrode 270 may be grounded. When the anode electrode 270 is grounded, it is necessary to apply the negative high voltage NHY to the gate electrode 250 and the cathode electrode 210. In order to provide such power, it is necessary to provide the negative high voltage NHY to the cathode electrode 210 and on the basis of this, generate a voltage to be provided to the gate electrode 250 in order to provide an emission electric field. Accordingly, it is not easy to configure a power supply for which insulation and stability are ensured. The electric field emission current control unit 300 of the inventive concept may provide power of high stability to the field electron emission type X-ray generator 200 of which the anode electrode 270 is grounded.

Figure 4:
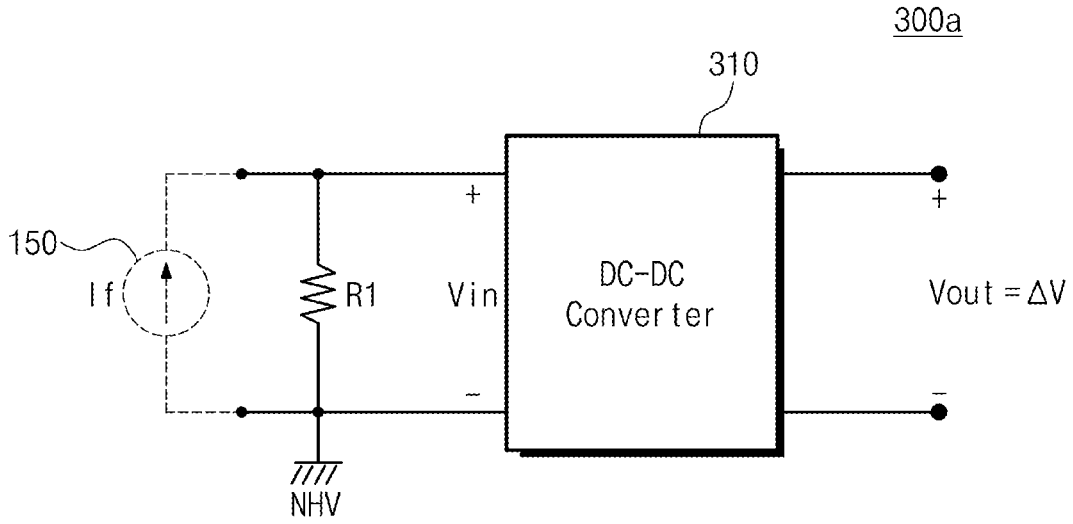
FIG. 4 is a circuit diagram showing a method for generating a voltage to be provided to a gate electrode on the basis of a negative high voltage (NHY) at the field emission current control unit 300*a* of an embodiment of the inventive concept.

FIG. 4 is a circuit diagram for showing a method for generating a voltage provided to a gate electrode on the basis of a negative high voltage (NHY) at the field electron emission current control unit 300*a* of an embodiment of the inventive concept. Referring to FIG. 4, the field emission current control unit 300*a* may generate a gate voltage NHV+ΔV using the filament current If on the basis of the negative high voltage NHY. A detailed description thereabout is as follows.

The field emission current control unit 300*a* may receive the filament current If from the thermal electron emission type X-ray generator 100. The field emission current control unit 300*a* applies the filament current If to a resistor R1 to convert to the input voltage Vin of several V. In addition, the field emission current control unit 300*a* converts the input voltage Vin of several V to an output voltage Vout using a DC-DC converter 310. Here, the input voltage Vin and the output voltage Vout are relatively positive voltages indicated based on the negative high voltage NHY. For example, when the negative high voltage NHY is −200 kV, a potential of a node NO is (−200 kV+Vin). Accordingly, an absolute potential of the node NO is higher than the negative high voltage NHY only by the input voltage Vin. Furthermore, the output voltage Vout will be a negative voltage of a level of several kV higher than the negative high voltage NHY. The output voltage Vout may be a voltage ΔV between the foregoing cathode electrode 210 and gate electrode 250.

Consequently, the input voltage Vin and the output voltage Vout generated through the filament current If have relatively higher voltage level with respect to the negative high voltage NHY provided by the negative high voltage generator 110. Accordingly, the input voltage Vin and the output voltage Vout may still belong to a negative voltage category on the basis of the ground level 0 V. Such a level relation will be described in detail in relation to graphs to be described below.

Hereinabove, a method and device for generating the gate voltage NHV+ΔV on the basis of the negative high voltage NHY. The gate voltage NHV+ΔV may be stably and easily generated using the filament current If.

Figure 5:
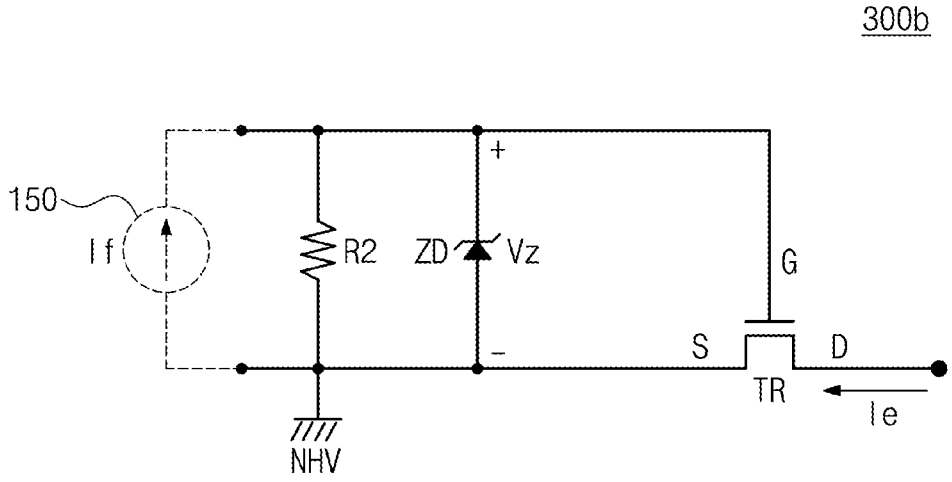
FIG. 5 is a circuit diagram showing a method and device for controlling the magnitude of an emission current le flowing through a cathode electrode by the field emission current control unit 300*b* of the inventive concept.

FIG. 5 is a circuit diagram showing a method and configuration for controlling the magnitude of an emission current Ie flowing through the cathode electrode 210 (see FIG. 3) by the field electron emission current control unit 300*b* of the inventive concept. Referring to FIG. 5, the field emission current control unit 300*b* may include a resistor R2, a Zener diode ZD and an NMOS transistor TR. With the configuration, the field emission current control unit 300*b* may use the filament current If to stably control the level of the emission current Ie on the basis of the negative high voltage NHY.

The field emission current control unit 300*b* may receive the filament current If from the thermal electron emission type X-ray generator 100. The field emission current control unit 300*b* may apply the filament current If to the resistor R2 to convert the filament current If to a diode voltage Vz. The field emission current control unit 300*b* includes the Zener diode ZD for constantly maintaining the level of the diode voltage Vz. The Zener diode ZD may be connected to the resistor R2 in parallel and maintain, at a constant level, the diode voltage Vz generated using the filament current If. The generated diode voltage Vz is a voltage of which a level is raised by a constant level on the basis of the negative high voltage NHY.

The generated diode voltage Vz is provided to the gate stage G of the NMOS transistor TR. In addition, the source stage S of the NMOS transistor TR may be biased to the negative high level NHY. Under such a bias condition, when the negative high voltage NHY and the gate voltage are provided to the cathode electrode 210 and the gate electrode 250 of the field electron emission type X-ray generator 200, an electric field is generated and an electron is emitted from the electron emission emitter 215. At this point, the emission current Ie corresponding to the emitted electron flows through the cathode electrode 210. However, the magnitude of the emission current Ie is dependent on a gate-source voltage Vgs of the NMOS transistor TR. The gate-source voltage Vgs of the NMOS transistor TR may be maintained at the level of the diode voltage Vz controlled by the Zener diode ZD. Accordingly, the magnitude of the emission current Ie may be determined through selection of a specification of the Zener diode ZD and a specification of the NMOS transistor TR.

Figure 6:
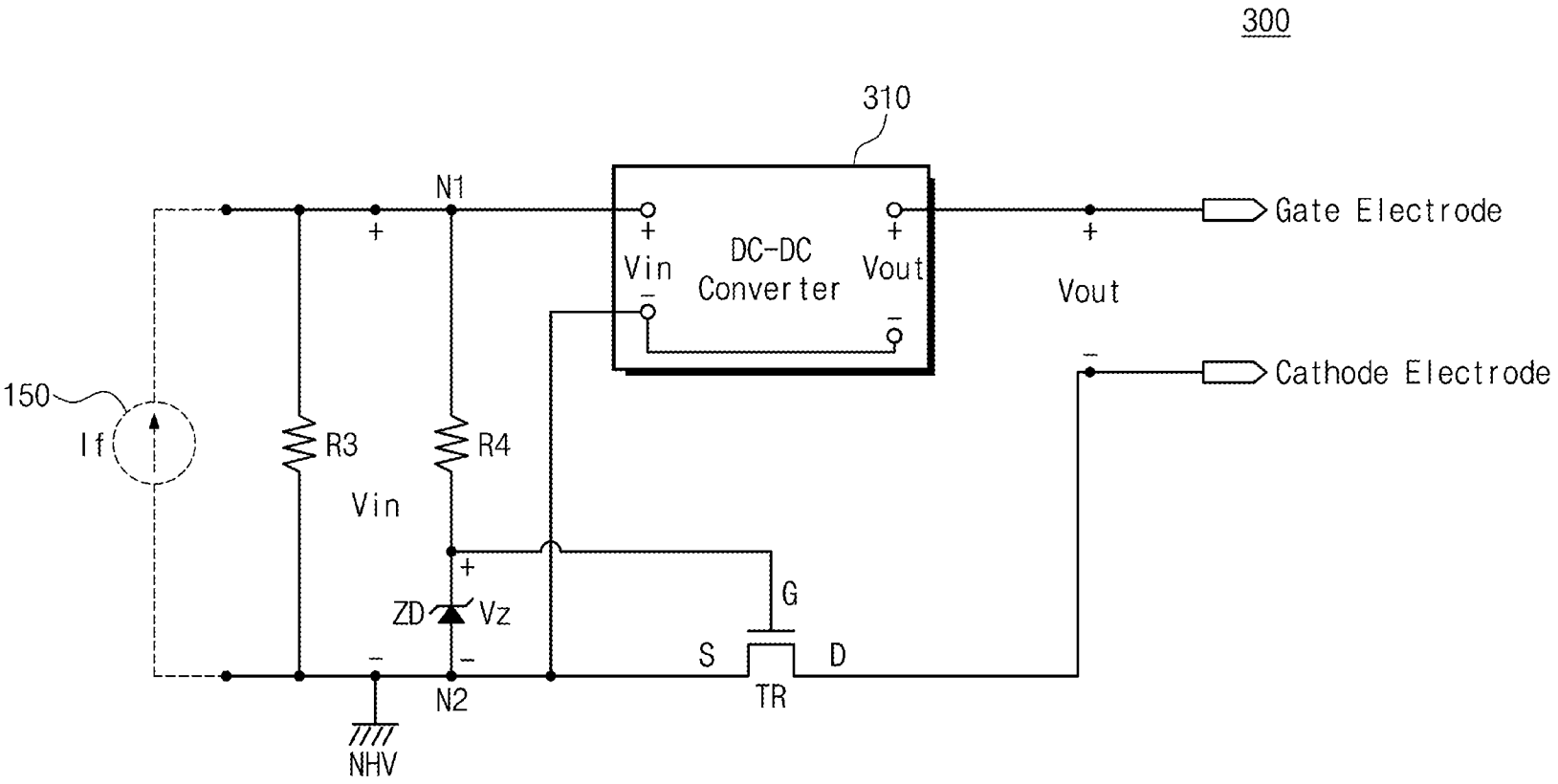
FIG. 6 is a circuit diagram showing a configuration of the field emission current control unit 300 according to an embodiment of the inventive concept.

FIG. 6 is a circuit diagram showing a configuration of the field emission current control unit 300 according to an embodiment of the inventive concept. Referring to FIG. 6, the field emission current control unit 300 may use the filament current If to generate a gate-cathode voltage Vgc provided to the gate electrode 250 (see FIG. 3). In addition, the field emission current control unit 300 may use the filament current If to stably control the emission current Ie flowing through the cathode electrode 210 (see FIG. 3).

The field emission current control unit 300 may receive the filament current If from the thermal electron emission type X-ray generator 100. The field emission current control unit 300 applies the filament current If to a resistor R3 to convert the filament current to the input voltage Vin. The input voltage Vin is relatively higher than the negative high voltage NHY. In other words, a potential of a second node N2 is maintained at the level of the negative high voltage NHY and a potential of a first node N1 has a higher level by the input level Vin than the negative high voltage NHY.

The input voltage Vin is provided to the DC-DC converter 310. The DC-DC converter 310 steps up the input voltage Vin to the output voltage Vout. The output voltage Vout may be provided to the gate electrode 250. Both of the input voltage Vin and the output voltage Vout of the DC-DC converter 310 may be provided to have levels higher than the negative high voltage NHV by several V to several kV. In the end, it may be noted that the output voltage is controlled by the magnitude of the filament current If. Since the output voltage Vout linearly varies with respect to the filament current If, the gate-cathode voltage may be easily provided based on the negative high voltage through the control of the filament current If.

In addition, the field emission current control unit 300 may include a resistor R4, the Zener diode ZD, and the NMOS transistor TR in order to provide the stable emission current Ie. The resistor R4 and the Zener diode ZD serially connected divide the input voltage Vin. In addition, the diode voltage Vz obtained by dividing the input voltage Vin by the Zener diode ZD is provided to the gate-source voltage of the NMOS transistor TR. Furthermore, the drain stage D of the NMOS transistor TR is connected to the cathode electrode 210.

Under the foregoing condition, when the negative high voltage NHY is provided to the cathode electrode 210 and the output voltage Vout is provided to the gate electrode 250, electrons start to be emitted from the electron emission emitter 215. The emission current Ie generated according to the emission of the electrons flows into the drain side of the NMOS transistor TR. However, when a level of the gate-source voltage of the NMOS transistor TR is maintained to the diode voltage Vz, a channel size of the NMOS transistor TR is maintained to be fixed. Accordingly, the level of the emission current le may be fixed to a stable value according to characteristics of the Zener diode ZD. In the end, it is possible to adjust the gate voltage level and the magnitude of the emission current le by adjusting the magnitude of the filament current lf.

According to the above-description, parameters of the field emission current control unit 300 may be easily selected according to the characteristics of the field electron emission type X-ray generator 200. In other words, a step-up ratio of the DC-DC converter 310, a breakdown voltage of the Zener diode, the size of the NMOS transistor TR or the like included in the field emission current control unit 300 may be selected according to required characteristics of the field electron emission type X-ray generator 200.

Figure 7:
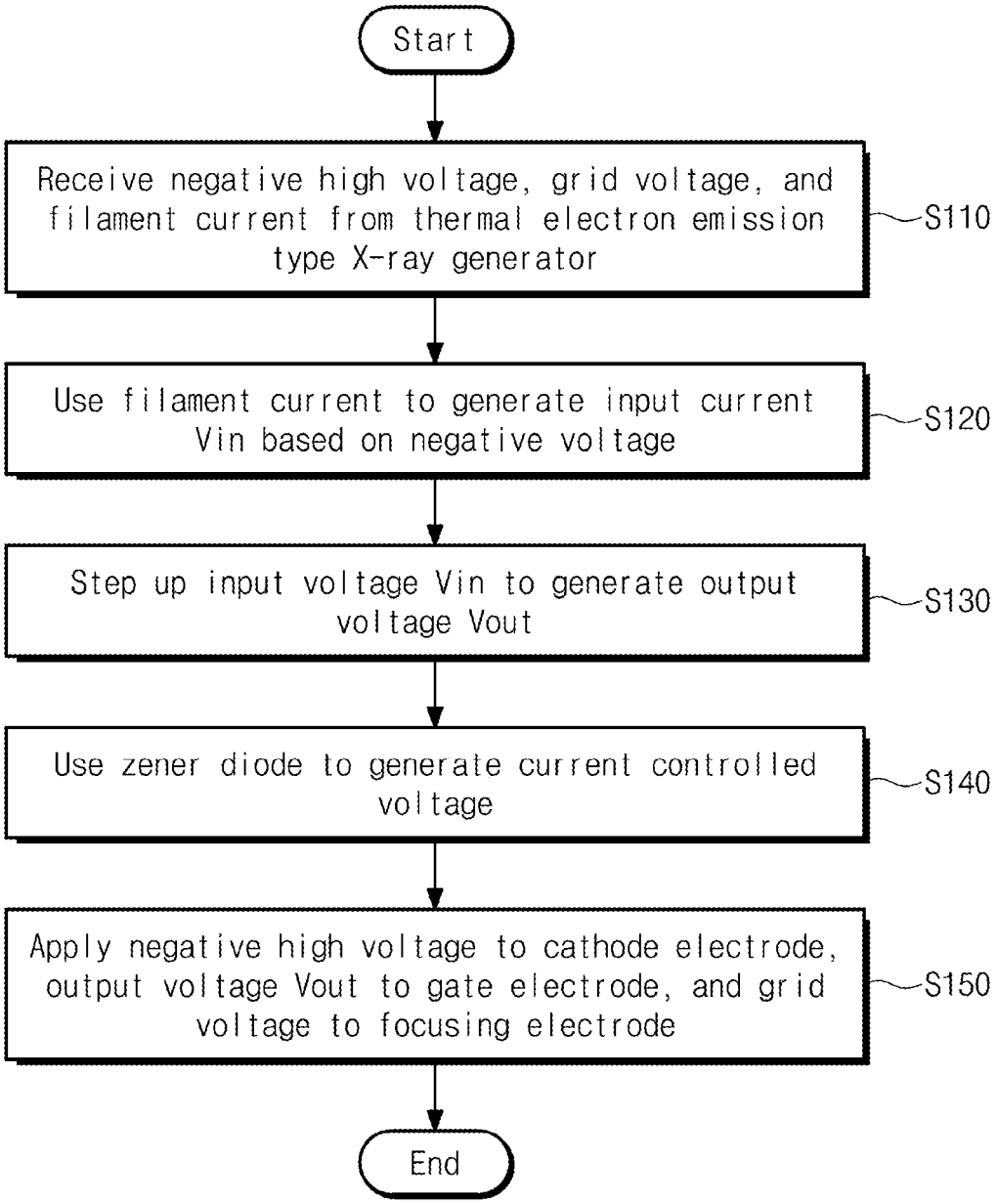
FIG. 7 is a flowchart simply showing a method for supplying power to the field electron emission type X-ray generator 200 according to an embodiment of the inventive concept.

FIG. 7 is a flowchart simply showing a method for supplying power to the field electron emission type X-ray generator 200 according to an embodiment of the inventive concept. Referring to FIGS. 6 and 7, an operation of the field emission current control unit 300 for providing power to the field electron emission type X-ray generator 200 will be sequentially described.

In operation S110, the negative high voltage NHY, the grid voltage Vgrd, and the filament current lf are provided from the heat electron emission type X-ray generator 100. Here, a delivery operation of the field emission current control unit 300 for the grid voltage Vgrd has not been described in detail in the foregoing embodiment. The grid voltage Vgrd may be directly provided from the thermal electron emission type X-ray generator 100 to the field electron emission type X-ray generator 200 without a separate process by the field emission current control unit 300. In addition, it will be well understood that the grid voltage Vgrd may be adjusted by the field emission current control unit 300 or other means in order to be provided to the focusing electrode 230 of the field electron emission type X-ray generator 200.

In operation S120, the field emission current control unit 300 generates the input voltage Vin using the filament current lf. In other words, the field emission current control unit 300 may apply the filament current lf to a resistor to generate the input voltage Vin. The input voltage Vin means a relative voltage on the basis of the negative high voltage NHY. In other words, the input voltage Vin means a level higher than the negative high voltage NHY by several V or dozens V.

In operation S130, the field emission current control unit 300 steps up the input voltage Vin to output the stepped-up input voltage Vin as the output voltage Vout to be provided to the gate electrode 250. In other words, the input voltage Vin may be input to the DC-DC converter 310 to be output as the stepped-up output voltage Vout. Both of the input voltage Vin and the output voltage Vout may have higher values than the negative high voltage NHY by several V to several kV.

In operation S140, the field emission current control unit 300 divides the input voltage Vin or uses a voltage regulator such as the Zener diode ZD to generate the current controlled voltage Vz. The current controlled voltage Vz may be provided as the gate-source voltage of the NMOS transistor TR that transfers the negative high voltage NHY to the cathode electrode 210.

In operation 5150, when the negative high voltage NHY is applied to the cathode electrode 210, the output voltage Vout to the gate electrode 250, and the gird voltage Vgrd to the focusing electrode 230, electrons start to be emitted from the electron emission emitter 215. In addition, the emission current le generated by the electrons emitted from the electron emission emitter 215 may maintain a level fixed by the current controlled voltage Vz.

Hereinabove, the brief description has been provided about a method for providing power to the field electron emission type X-ray generator 200 of which anode electrode 270 is grounded. First, the negative high voltage NHY, the filament current lf and the grid voltage Vgrd are provided from the heat electron emission type X-ray generator 100. In addition, the output voltage Vout, which is stepped up by a prescribed level lf on the basis of the negative high voltage NHY, and the current controlled voltage Vz are generated using the filament current. The output voltage Vout is provided to the gate electrode 250, and the negative high voltage NHY is provided to the cathode electrode 210. In addition, the current controlled voltage Vz is used as the gate-source voltage of the transistor that delivers the negative high voltage NHY to the cathode electrode 210. When the power supplying manner of the inventive concept is used, power may be efficiently and stably provided to the field electron emission type X-ray generator 200 in a type that the anode electrode 270 is grounded.

Figure 8:
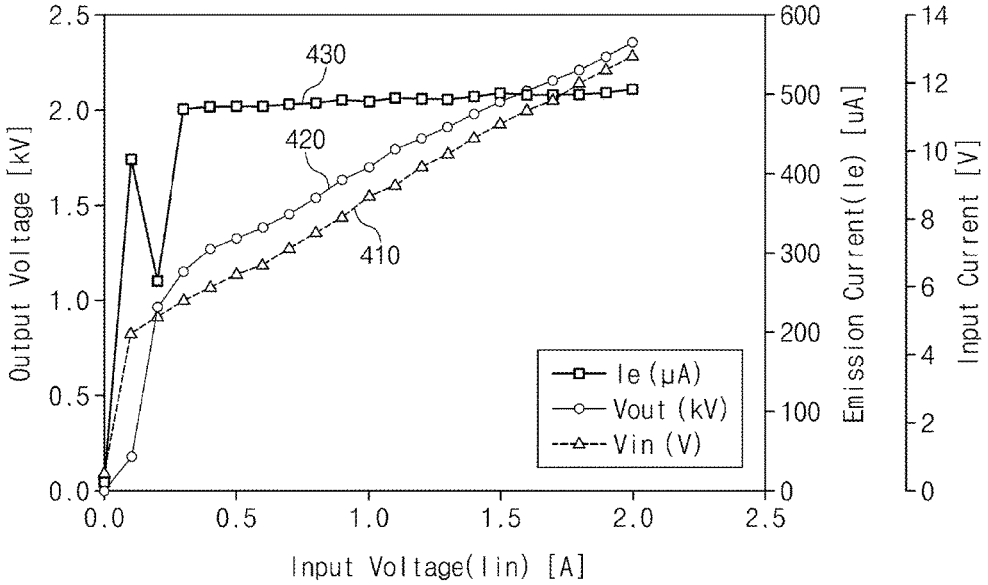
FIG. 8 is a graph exemplarily showing driving characteristics of the X-ray generator 10 of an embodiment of the inventive concept.

FIG. 8 is a graph exemplarily showing a driving characteristic of an X-ray generator 10 of an embodiment of the inventive concept. Referring to FIG. 8, the input current lin means a current input to the field emission current control unit 300. In other words, the input current lin may be a filament current lf. According to the magnitude of the input current lin, a curve 410 representing a change in the input voltage Vin, a curve 420 representing a change in the output voltage Vout, and a curve 430 representing the magnitude of the emission current le are illustrated.

According to the curve 410, it may be seen that the input voltage Vin linearly increases with respect to the input current lin in a range of the input current lin equal to or greater than 0.3 A. Accordingly, it may also be seen that the output voltage Vout stepped up at a specific step-up rate for the input voltage Vin linearly increases with respect to the input current lin. Such a type of the output voltage Vout is represented as the curve 420.

Furthermore, referring to the curve 430, it may be checked that the emission current le maintains a stable level in a range of the input current lin equal to or greater than 0.3 A. When the magnitude of the input current lin varies in this range, it may be checked that the emission current le maintains almost 500 μA level.

Referring to the foregoing drawings, it is possible to stably control the gate-cathode voltage and emission current le by the field emission current control unit 300 of the inventive concept.

Figure 9A:
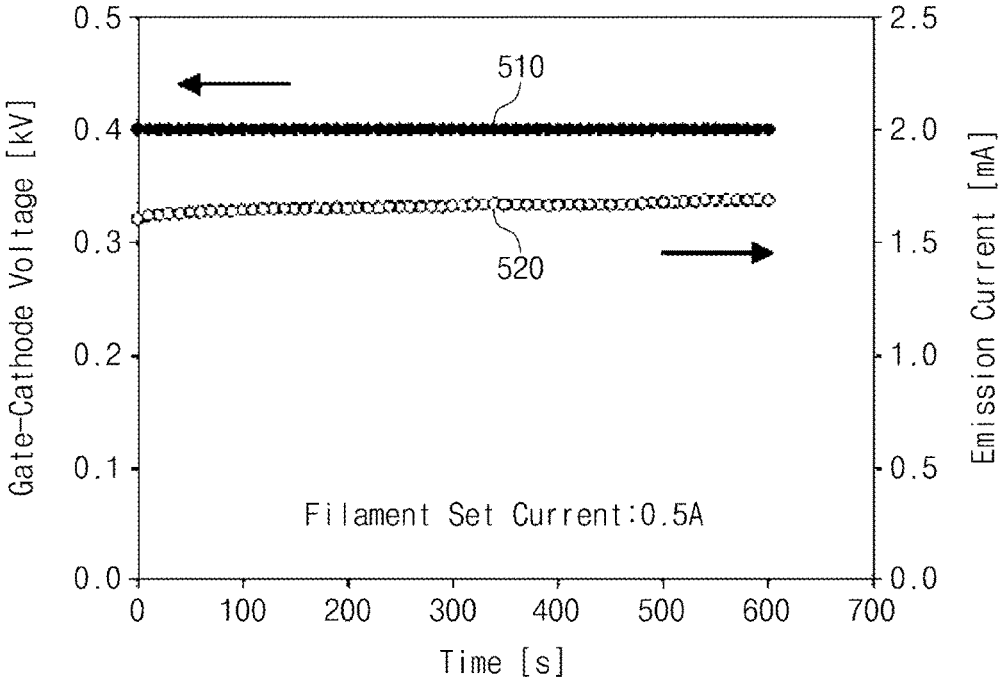
FIGS. 9A and 9B are graphs showing stable outputs of the emission current le and the gate voltage of the X-ray generator 10 according to an embodiment of the inventive concept.
Figure 9B:
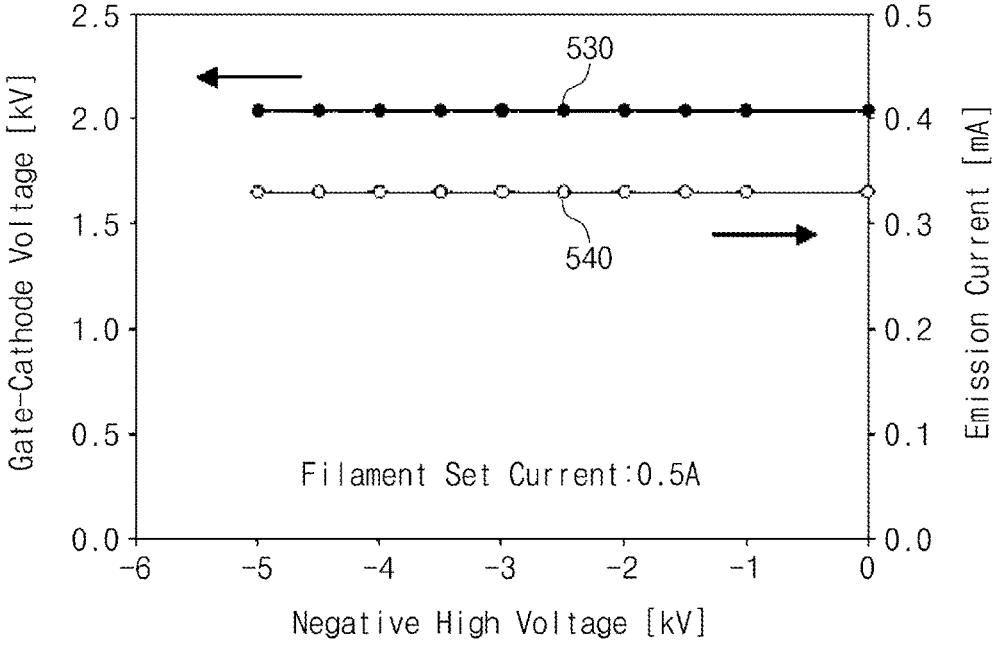

FIGS. 9A and 9B are graphs showing stable outputs of the emission current le and the gate voltage of the X-ray generator 10 according to an embodiment of the inventive concept. FIG. 9A is a graph showing changes in the gate voltage and emission current le according to passage of time, when the filament current lf is fixed. FIG. 9B is a graph showing changes in the gate voltage and emission current le according to a level change in the negative high voltage, when the filament current lf is fixed.

Referring FIG. 9A, the level changes are illustrated in the gate-cathode voltage Vout and the emission current le according to the passage of time. The gate-cathode voltage Vout is illustrated with a curve 510 according to a change in time, when the anode electrode 270 of the field electron emission type X-ray generator 200 (see FIG. 3) is grounded and the filament current lf fixed to 0.5 A is provided. In addition, under the same condition, a curve 520 is illustrated which shows a change in the level of the emission current le. In the end, when the fixed filament current lf is provided, the gate-cathode voltage Vout of a constant level may be provided regardless of the time and the emission current le may maintain a target level.

Referring FIG. 9B, voltage and current characteristics are illustrated when the anode electrode 270 of the field electron emission type X-ray generator 200 (see FIG. 3) is grounded, the filament current lf is fixed to 0.5 A, and the negative high voltage NHY is sequentially changed. At this point, the gate-cathode voltage Vout between the cathode electrode 210 and the gate electrode 250 may constantly maintain about 2.0 kV. In addition, the level of the emission current le may also maintain a constant value as illustrated in a curve 540 with respect to the level change of the negative high voltage NHY.

According to the field emission current control unit 300 of the inventive concept, when the filament current lf is fixedly provided, the gate-cathode voltage Vout of a constant level may be provided regardless of the time on the basis of the negative high voltage NHY. In addition, it may be checked that the emission current le may be stably provided.

According to embodiments of the inventive concept, it is possible to drive the field electron emission type X-ray generator and easily control a field emission current by using a power supply source of a thermal electron emission type X-ray generator. Accordingly, the field electron emission type X-ray generator of which an anode electrode is grounded may be very stably driven.

Although the exemplary embodiments of the present invention have been described, it is understood that the present disclosure should not be limited to these exemplary embodiments but various changes and modifications can be made by one ordinary skilled in the art within the spirit and scope of the present invention as hereinafter claimed.

What is claimed is:

1. An X-ray generator comprising:

a thermal electron emission type X-ray generator configured to generate a negative high voltage and a filament current;

a field electron emission type X-ray generator comprising an anode electrode to be grounded and a cathode electrode, and configured to use the negative high voltage to bias the cathode electrode; and a field emission current control unit configured to convert the filament current to generate an output voltage to be provided to a gate electrode of the field electron emission type X-ray generator and convert the filament current to fix, to a specific level, a level of an emission current flowing through the cathode electrode.

2. The X-ray generator of claim 1, wherein the field emission current control unit comprises a first resistor configured to convert the filament current to an input voltage.

3. The X-ray generator of claim 2, wherein the field emission current control unit comprises a DC-DC converter configured to step up the input voltage to the output voltage.

4. The X-ray generator of claim 2, wherein the field emission current control unit comprises:

a voltage regulator configured to convert the input voltage to a current controlled voltage of a static voltage; and a switch element configured to deliver the negative high voltage to the cathode electrode in response to the current controlled voltage.

5. The X-ray generator of claim 4, wherein the field emission current control unit comprises:

a second resistor configured to divide the input voltage; and the voltage regulator is connected to the second resistor.

6. The X-ray generator of claim 5, wherein the switch element is provided as a transistor configured to deliver the negative high voltage to the cathode electrode, and the current controlled voltage is provided to a gate-source voltage of the transistor.

7. The X-ray generator of claim 4, wherein the voltage regulator is a Zener diode.

8. The X-ray generator of claim 1, wherein the field electron emission type X-ray generator receives, as a focusing voltage, a grid voltage of the thermal electron emission type X-ray generator.

9. An X-ray generator comprising:

a field electron emission type X-ray generator of which anode electrode is grounded; and a field emission current control unit configured to receive a source current to generate an output voltage to be provided to a gate electrode of the field electron emission type X-ray generator on a basis of a negative high voltage, and use the source current to control an emission current flowing through a cathode electrode of the field electron emission type X-ray generator, wherein the source current is a filament current of a thermal electron emission type X-ray generator.

10. The X-ray generator of claim 9, wherein the field emission current control unit uses a first resistor to convert the source current to an input voltage higher than the negative high voltage.

11. The X-ray generator of claim 10, wherein the field emission current control unit comprises a DC-DC converter configured to step up the input voltage to the output voltage.

12. The X-ray generator of claim 10, wherein the field emission current control unit comprises:

a second resistor configured to divide the input voltage; and a Zener diode serially connected to the second resistor.

13. The X-ray generator of claim 12, wherein the field emission current control unit comprises an NMOS transistor configured to deliver the negative high voltage to the cathode electrode, wherein voltages divided to both terminals of the Zener diode are provided as a gate-source voltage of the NMOS transistor.

14. The X-ray generator of claim 9, wherein the field electron emission type X-ray generator receives a grid voltage of the thermal electron emission type X-ray generator and provides the grid voltage to a focusing electrode of the field electron emission type X-ray generator.

15. A method for driving a field electron emission type X-ray generator of which an anode electrode is grounded, the method comprising:

receiving a negative high voltage and a filament current from a thermal electron emission type X-ray generator;

converting the filament current to generate an output voltage to be provided to a gate electrode of the field electron emission type X-ray generator;

converting the filament current to generate a current controlled voltage for controlling an emission current flowing through a cathode electrode of the field electron emission type X-ray generator; and providing the output voltage to the gate electrode and applying the current controlled voltage as a gate-source voltage of a transistor configured to deliver the negative high voltage to the cathode electrode of the field electron emission type X-ray generator.

16. The method of claim 15, wherein the generating of the output voltage comprises:

using a resistor to convert the filament current to an input voltage; and stepping up the input voltage to generate the output voltage.

17. The method of claim 16, wherein in the generating of the current controlled voltage, the current controlled voltage is generated by dividing the input voltage and using a Zener diode to convert the divided voltage to a static voltage.

18. The method of claim 15, further comprising:

receiving a grid voltage of the thermal electron emission type X-ray generator to provide the grid voltage to a focusing electrode of the field electron emission type X-ray generator.

* * * * *